US005439068A

United States Patent [19]

Huffstutler et al.

[11] Patent Number: 5,439,068

[45] Date of Patent: Aug. 8, 1995

[54] MODULAR ROTARY DRILL BIT

[75] Inventors: Alan D. Huffstutler, Grand Prairie; Wesley P. Dietz, DeSoto, both of Tex.

[73] Assignee: Dresser Industries, Inc., Dallas, Tex.

[21] Appl. No.: 287,446

[22] Filed: Aug. 8, 1994

[51] Int. Cl.[6] ..... E21B 10/08; E21B 10/24

[52] U.S. Cl. ..... 175/356; 175/227; 76/108.4

[58] Field of Search ..... 175/356, 357, 366, 367, 175/331, 369, 227, 374; 76/108.2, 108.4

[56] References Cited

U.S. PATENT DOCUMENTS

| | | | |
|---|---|---|---|
| Re. 19,339 | 10/1934 | Vertson . | |
| 1,906,427 | 5/1933 | Sievers et al. . | |
| 1,908,049 | 5/1933 | Reed | 175/367 |
| 2,030,723 | 2/1936 | Scott et al. | 175/363 |
| 2,047,112 | 7/1936 | Reed | 175/363 |
| 2,063,012 | 12/1936 | Catland | 175/357 |
| 2,064,273 | 12/1936 | Scott | 175/342 |
| 2,065,743 | 12/1936 | Reed | 175/366 |
| 2,068,375 | 1/1937 | Catland | 175/357 |
| 2,124,521 | 7/1938 | Williams et al. | 175/366 |
| 2,151,347 | 3/1939 | Fisher | 175/366 |
| 2,318,370 | 5/1943 | Burch | 175/366 |
| 2,648,526 | 8/1953 | Lanchester | 175/366 |
| 2,782,005 | 2/1957 | Appleton | 175/366 |
| 3,628,616 | 12/1971 | Neilson | 175/375 |
| 3,800,891 | 4/1974 | White et al. | 175/374 |
| 3,825,083 | 7/1974 | Flarity et al. | 175/394 |
| 3,850,256 | 11/1974 | McQueen | 175/228 |
| 4,054,772 | 10/1977 | Lichte | 219/121 |
| 4,056,153 | 11/1977 | Miglierini | 175/376 |
| 4,067,406 | 1/1978 | Garner et al. | 175/341 |
| 4,280,571 | 7/1981 | Fuller | 175/337 |
| 4,333,364 | 6/1982 | Varel | 76/108 |
| 4,350,060 | 9/1982 | Vezirian | 76/108 |
| 4,352,400 | 10/1982 | Grappendorf et al. | 175/330 |
| 4,369,849 | 1/1983 | Parrish | 175/340 |
| 4,417,629 | 11/1983 | Wallace | 175/356 |
| 4,421,184 | 12/1983 | Mullins | 175/337 |
| 4,552,232 | 11/1985 | Frear | 175/337 |

OTHER PUBLICATIONS

U.S. Patent Application Ser. No. 08/287,457 filed Aug. 8, 1994 and entitled Rock bit with Enhanced Fluid Return Area (Attorney's Docket 60220-0169).

(List continued on next page.)

*Primary Examiner*—Stephen J. Novosad
*Attorney, Agent, or Firm*—Baker & Botts

[57] ABSTRACT

A rotary cone drill bit for forming a borehole having a one-piece bit body with a lower portion having a convex exterior surface and an upper portion adapted for connection to a drill string. The drill bit will generally rotate around a central axis of the bit body. A number of support arms are preferably attached to pockets formed in the bit body and depend therefrom. Each support arm has an inside surface with a spindle connected thereto and an outer surface. Each spindle projects generally downwardly and inwardly with respect to the longitudinal axis of the associated support arm and the central axis of the bit body. A number of cone cutter assemblies equal to the number of support arms are mounted respectively on each of the spindles. The spacing between each of the support arms along with their respective length and width dimensions are selected to enhance fluid flow between the cutter cone assemblies mounted on the respective support arms and the lower portion of the bit body. A lubricant reservoir is preferably provided in each support arm to supply lubricant to one or more bearing assemblies disposed between each cutter cone assembly and its associated spindle. Either matching openings and posts or matching keyways and keys may be used to position and align a portion of each support arm within its associated pocket during fabrication of the resulting drill bit.

23 Claims, 5 Drawing Sheets

U.S. PATENT DOCUMENTS

| | | | |
|---|---|---|---|
| 4,623,027 | 11/1986 | Vezirian | 175/340 |
| 4,630,693 | 12/1986 | Goodfellow | 175/366 |
| 4,711,143 | 12/1987 | Loukanis et al. | 76/108 |
| 4,727,943 | 3/1988 | Wood | 175/229 |
| 4,750,573 | 6/1988 | Wynn | 175/359 |
| 4,765,205 | 8/1988 | Higdon | 76/108 |
| 4,848,491 | 7/1989 | Burridge et al. | 175/329 |
| 4,986,375 | 1/1991 | Maher | 175/323 |
| 5,040,623 | 8/1991 | Vezirian | 175/354 |
| 5,074,367 | 12/1991 | Estes | 175/374 |
| 5,131,478 | 7/1992 | Brett | 175/57 |
| 5,145,016 | 9/1992 | Estes | 175/331 |
| 5,199,516 | 4/1993 | Fernandez | 175/366 |
| 5,224,560 | 7/1993 | Fernandez | 175/374 |
| 5,289,889 | 3/1994 | Gearhart | 175/325.5 |

OTHER PUBLICATIONS

U.S. Patent Application Ser. No. 08/287,441 filed Aug. 8, 1994 and entitled Rotary Cone Drill Bit with Improved Support Arms (Attorney's Docket 60220–0171).

U. S. Patent Application Ser. No. 08/287,390 filed Aug. 8, 1994 and entitled Rotary Drill Bit and Method for Manufacture and Rebuild (Attorney's Docket 60220–0172).

U.S. Design Patent Application Ser. No. 29/033,599, filed Jan. 17, 1995 and entitled Rotary Cond Drill Bit (Attorney's Docket 60220–0173).

U.S. Design Patent Application Ser. No. 29/033,630 Filed Jan. 17, 1995 and entitled Support Arm and Rotary Cone for Modular Drill Bit (Attorney's Docket 60220–0174).

U.S. Patent Application Ser. No. 08/351,019 filed Dec. 7, 1994 and entitled Rotary Cone Drill Bit and Mehtod for Enhanced Lifting of Fluids and Cuttings (Attorney's Docket 60220–0178).

U.S. patent application Ser. No. 08/350,910 filed Dec. 7, 1994 and entitled Rotary Cone Drill Bit with Angled Ramps (Attorney's Docket 60220–0179).

Security/Dresser "Security Oilfield Catalog" Rock Bits, Diamond Products, Drilling Tools, *Security Means Technology.*

"State of the Science in Rock Bit Techn." by Carols Fernandez, Spacebit.

22
44
42
26
24
40
28
126
20
52
86
84
48
60
46
70
160
70
88
100
102
104
104
102
100

MODULAR ROTARY DRILL BIT

RELATED APPLICATION

This application is related to copending application entitled Rock Bit With Enhanced Fluid Return Area, Ser. No. 08/287,457 filed Aug. 8, 1994 (Attorney's Docket 60220-0169); copending application entitled Rotary Cone Drill Bit With Improved Support Arms, Ser. No. 08/287,441 filed Aug. 8, 1994 (Attorney's Docket 60220-0171); copending application entitled Rotary Drill Bit and Method for Manufacture and Rebuild, Ser. No. 08/287,390 filed Aug. 8, 1994 (Attorney's Docket 60220-0172); copending application entitled Rotary Cone Drill Bit, Ser. No. 29/033,599 filed Jan. 17, 1995 (Attorney's Docket 60220-0173); copending application entitled Support Arm and Rotary Cone for Modular Drill Bit, Ser. No. 29/033,630 filed Jan. 17, 1995 (Attorney's Docket 60220-0174); copending application entitled Rotary Cone Drill Bit and Method for Enhanced Lifting of and Cuttings, Ser. No. 08/351,019, filed Dec. 7, 1994 (Attorney's Docket 60220-0178); and copending application entitled Rotary Cone Drill Bit With Angled Ramps, Ser. No. 08/350,910, filed Dec. 7, 1994 (Attorney's Docket 60220-0179).

TECHNICAL FIELD OF THE INVENTION

This invention relates in general to rotary drill bits used in drilling a borehole in the earth and in particular to a drill bit having a one piece bit body with one or more support arms attached to the bit body.

BACKGROUND OF THE INVENTION

Various types of rotary drill bits or rock bits may be used to form a borehole in the earth. Examples of such rock bits include roller cone bits or rotary cone bits used in drilling oil and gas wells. A typical roller cone bit comprises a bit body with an upper end adapted for connection to a drill string. A plurality of support arms, typically three, depend from the lower end portion of the bit body with each arm having a spindle protruding radially inward and downward with respect to a projected rotational axis of the bit body.

Conventional roller cone bits are typically constructed in three segments. The segments may be positioned together longitudinally with a weld groove between each segment. The segments may then be welded with each other using conventional techniques to form the bit body. Each segment also includes an associated support arm extending from the bit body. An enlarged cavity or passageway is typically formed in the bit body to receive drilling fluids from the drill string. U.S. Pat. No. 4,054,772 entitled, Positioning System for Rock Bit Welding shows a method and apparatus for constructing a three cone rotary rock bit from three individual segments. U.S. Pat. No. 4,054,772 is incorporated by reference for all purposes within this application.

A cutter cone is generally mounted on each spindle and supported rotatably on bearings acting between the spindle and the inside of a spindle receiving cavity in the cutter cone. One or more nozzles may be formed on the underside of the bit body adjacent to the support arms. The nozzles are typically positioned to direct drilling fluid passing downwardly from the drill string through the bit body toward the bottom of the borehole being formed. Drilling fluid is generally provided by the drill string to perform several functions including washing away material removed from the bottom of the borehole, cleaning the cutter cones, and carrying the cuttings radially outward and then upward within the annulus defined between the exterior of the bit body and the wall of the borehole. U.S. Pat. No. 4,056,153 entitled, Rotary Rock Bit with Multiple Row Coverage for Very Hard Formations and U.S. Pat. No. 4,280,571 entitled, Rock Bit show examples of conventional roller cone bits with cutter cone assemblies mounted on a spindle projecting from a support arm. U.S. Pat. No. 4,056,153 and U.S. Pat. No. 4,280,571 are incorporated by reference for all purposes within this application.

While drilling with such rotary or rock bits, cuttings and other types of debris may collect in downhole locations with restricted fluid flow. Examples of such locations with restricted fluid flow include the lower portion of the bit body adjacent to the respective support arms, the annulus area between the exterior of the bit body and the adjacent wall of the borehole. Other areas of restricted fluid flow may include the backface of the respective cutter cones and the wall of the borehole. As a result of collecting such debris, the area available for fluid flow is reduced even further resulting in an increase in fluid velocity through such areas and erosion of the adjacent metal components. As this erosion progresses, vital components such as bearings and seals may be exposed to drilling fluids and well debris which can lead to premature failure of the associated rock bit.

SUMMARY OF THE INVENTION

In accordance with the present invention, the disadvantages and problems associated with previous rock bits and rotary cone drill bits have been substantially reduced or eliminated. One aspect of the present invention includes a one-piece or unitary bit body which provides enhanced fluid flow around the exterior of the associated rotary drill bit during drilling operations and enhanced fluid flow for removal of cuttings and other debris from the bottom of the borehole to the well surface. The lower portion of the bit body adjacent to the associated support arms preferably includes a generally convex exterior surface which eliminates stagnation of cuttings and/or drilling fluids above a cutter cone assembly associated with each support arm. The convex surface of the bit body and spacing between the support arms promotes movement of cuttings and any other debris outwardly from the cutter cone assemblies towards the wall of the borehole and upward through the annulus formed between the wall of the borehole and the associated drill pipe.

Another aspect of the present invention includes a rotary cone drill bit having a one-piece bit body with at least three support arms disposed within pockets formed in the exterior of the bit body. The dimensions of each support arm and its associated pocket are preferably selected such that a substantial portion of the thickness of each support arm is contained within its associated pocket.

A further aspect of the present invention includes a rotary cone drill bit having a one-piece bit body with at least one support arm disposed within a pocket formed in the exterior of the bit body. The support arm may have a generally symmetrical configuration with respect to a longitudinal axis extending therethrough and an inside surface with a spindle projecting inwardly and downwardly from the inside surface for mounting a cutter cone assembly on the associated spindle. The support arm also includes a top surface, a shirttail surface, and a bottom edge. The inside surface and the shirttail surface are preferably contiguous at the bottom edge. For some applications, the length of each support arm from its top surface to its bottom edge may be selected to be at least three times the width of the support arm.

Important technical advantages of providing a rotary cone drill bit having a one-piece bit body with support arms attached to pockets formed in the bit body in accordance with the present invention include reducing the overall amount of raw material used to fabricate each support arm. Also, any desired offset between the projected axis of rotation for the drill bit and the associated cutter cone assemblies can be obtained by varying the location of the respective pockets without requiring a variation in the configuration of the support arms and/or respective spindle projecting therefrom. By eliminating the requirement for providing an offset in the support arm and/or twisting the support arm with respect to its associated spindle, both manufacturing and inventory costs may be substantially reduced by reducing the number of different types and designs of support arms. Additional cost savings may be achieved by several other factors including reduced shipping costs per support arm due to reduced weight and more support arms can be heat treated and processed at one time due to their reduced weight and smaller configuration. Also, fewer machine set-ups are required during manufacturing and fewer drawings or manufacturing files require updating for a design change due to standardization of the support arms. One of the significant cost savings results from the ability to offer customers the same wide range of drill bit sizes and offsets while substantially reducing the number of component parts which must be maintained in inventory to produce the various sizes and types of drill bits.

A further technical advantage of the present invention includes positioning a lubricant reservoir extending substantially parallel with the longitudinal axis of each support arm to provide greater ease for the manufacture and assembly of the support arm and lubricant reservoir. The location of the lubricant reservoir better protects an associated cap which seals the lubricant reservoir during downhole drilling operations.

In one aspect of the invention, a support arm and cutter cone assembly mounted on a unitary bit body of a rotary drill bit provide superior erosion protection. The assembly includes a support arm having an inside surface, a shirttail surface, and a bottom edge. A spindle is attached to the inside surface and is angled downwardly with respect to the support arm. The dimensions of the support arm and various machined areas formed on the inside surface of the support arm are selected to optimize fluid flow with respect to the support arm and cutter cone assembly mounted on the associated spindle.

A further technical advantage of the present invention includes the ability to manufacture a rotary cone drill bit having a bit body and support arms formed from different types of materials which is normally not possible using typical processing steps associated with the manufacture of a rotary cone drill bit having a bit body and support arms formed as an integral part thereof.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE INVENTION

Figure 1:
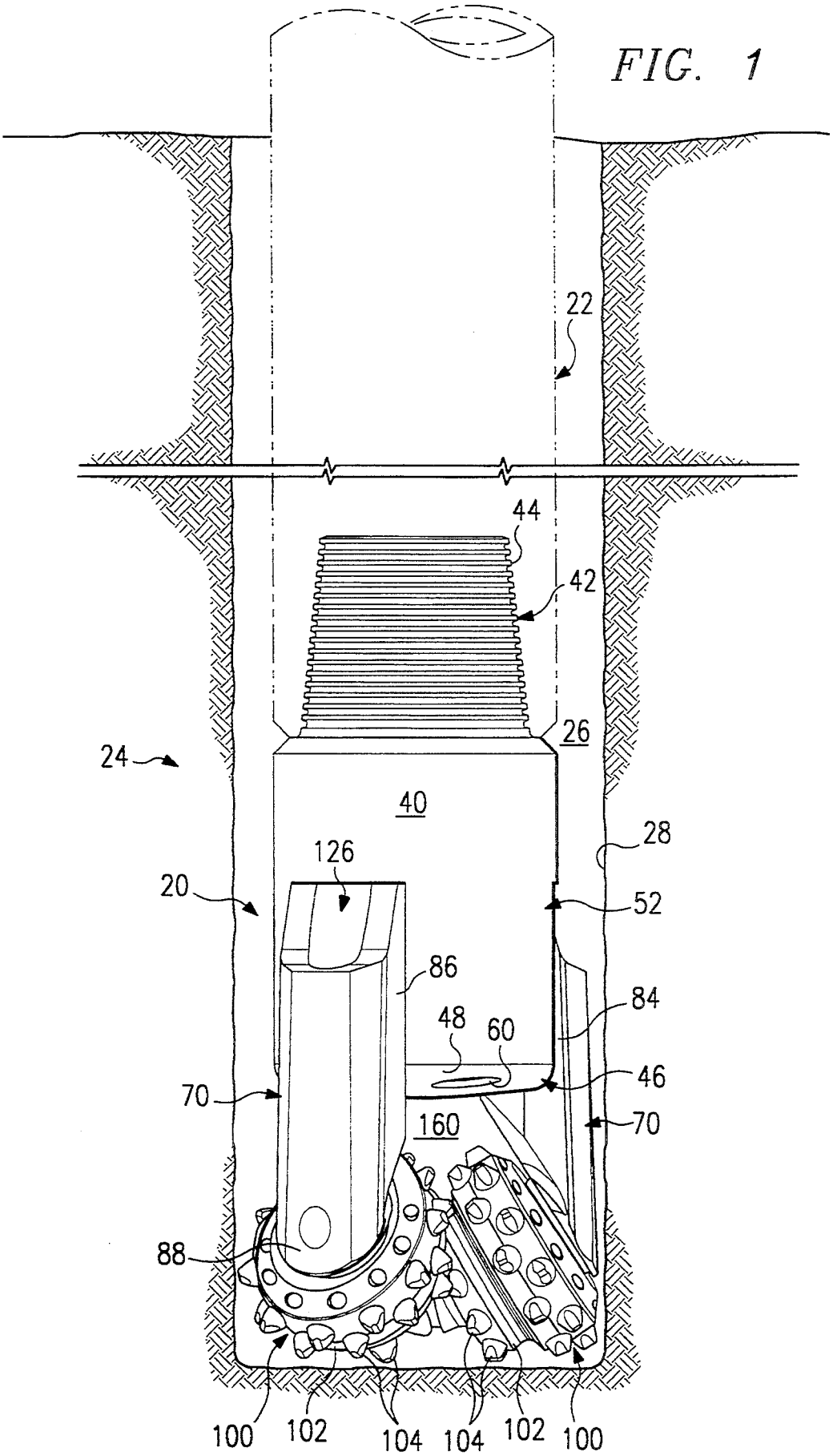
FIG. 1 is a schematic drawing in elevation and section with portions broken away of a rotary cone drill bit, incorporating features of the present invention attached to one end of a drill string disposed in a borehole.

The preferred embodiments of the present invention and its advantages are best understood by referring to FIGS. 1–8 of the drawings, like numerals being used for like and corresponding parts of the various drawings.

As shown in the drawings for purposes of illustration, the present invention is embodied in rotary cone drill bit 20 of the type used in drilling a borehole in the earth. Rotary come drill bit 20 may sometimes be referred to as a "rotary drill bit" or "rock bit." Rotary cone drill bit 20 preferably includes threaded connection or pin 44 for use in attaching drill bit 20 with drill string 22. Threaded connection 44 and the corresponding threaded connections (not shown) associated with drill string 22 are designed to allow rotation of drill bit 20 in response to rotation of drill string 22 at the well surface.

As shown in FIG. 1, drill bit 20 may be attached to drill string 22 and disposed in borehole 24. Annulus 26 is formed between the exterior of drill string 22 and the interior or wall 28 of borehole 24. In addition to rotating drill bit 20, drill string 22 is often used to provide a conduit for communicating drilling fluids (not shown) and other fluids from the well surface to drill bit 20 at the bottom of borehole 24. Such drilling fluids may be directed to flow from drill string 22 to various nozzles 60 provided in drill bit 20. Cuttings (not shown) formed by drill bit 20 and any other debris at the bottom of borehole 24 will mix with the drilling fluids exiting from nozzles 60 and return to the well surface via annulus 26.

For rotary cone drill bit 20 cutting action or drilling action occurs as cutter cone assemblies 100 are rolled around the bottom of borehole 24 by rotation of drill string 22. The resulting inside diameter of borehole 24 defined by wall 28 corresponds approximately with the outside diameter or gauge diameter of cutter cone assemblies 100. Cutter cone assemblies 100 cooperate with each other to form wall 28 of borehole 24 in response to rotation of drill bit 20. Cutter cone assemblies 100 may sometimes be referred to as "rotary cone cutters" or "roller cone cutters".

Figure 2:
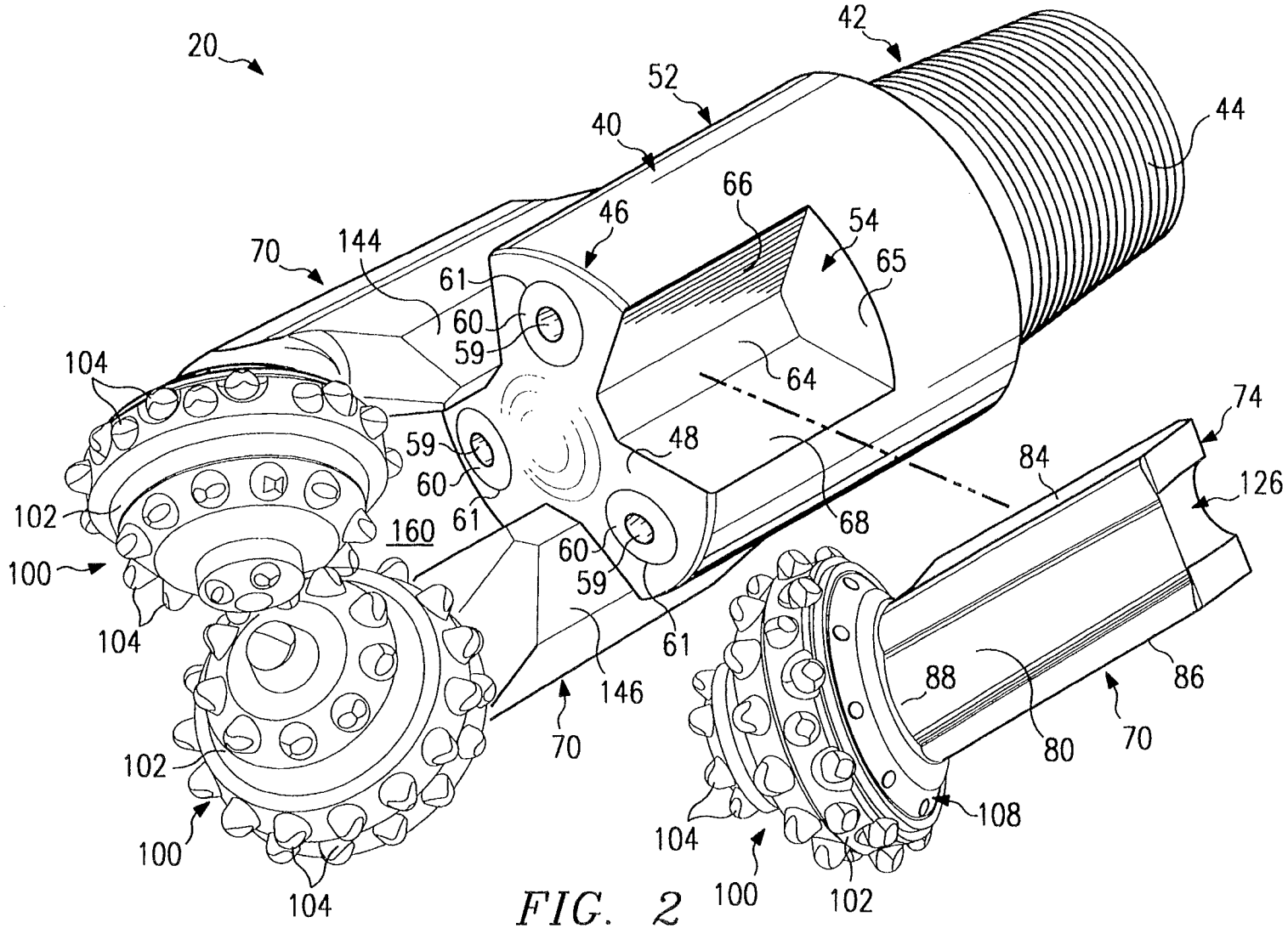
FIG. 2 is an isometric drawing showing a partially exploded view of a rotary cone drill bit incorporating an embodiment of the present invention.
Figure 3:
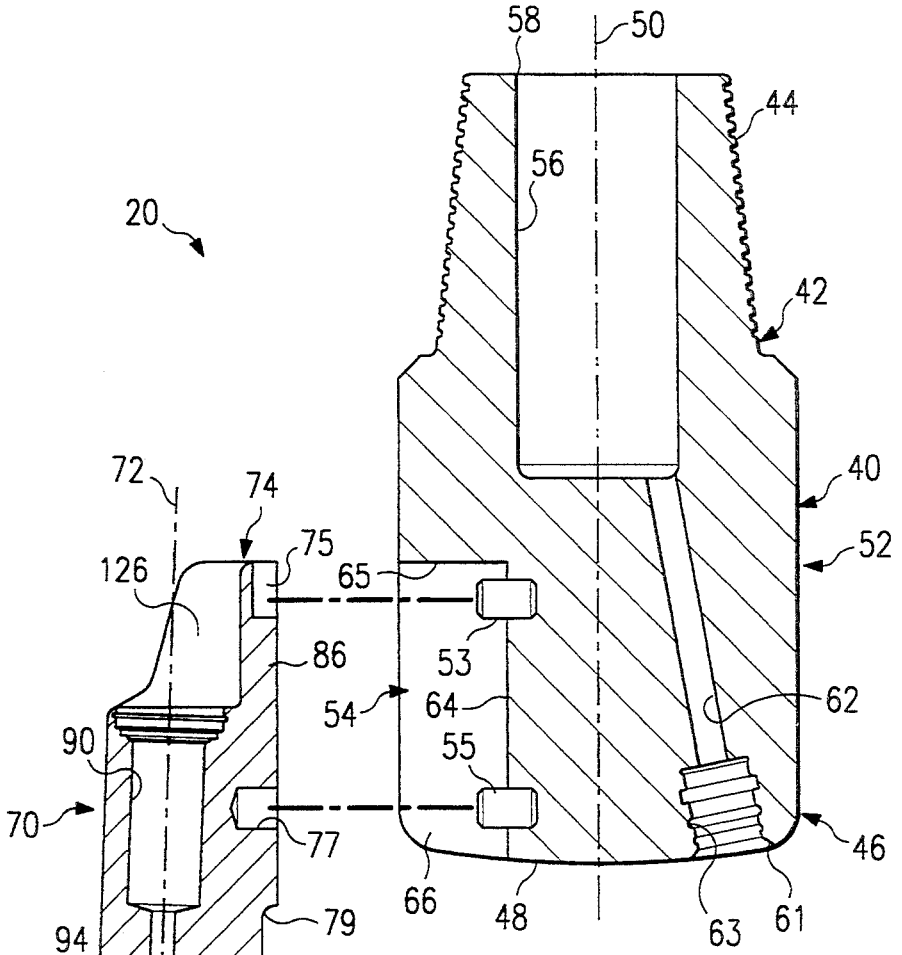
FIG. 3 is an exploded drawing in section showing portions of a one-piece bit body, support arm, and cutter cone assembly incorporating an embodiment of the present invention.

As shown in FIGS. 1, 2 and 3 each cutter cone assembly 100 includes cutting edges 102 with protruding inserts 104 which scrape and gouge against the sides and bottom of borehole 24 in response to the weight and rotation applied to drill bit 20 from drill string 22. The position of cutting edges 102 and inserts 104 for each cutter cone assembly 100 may be varied to provide the desired downhole cutting action. Other types of cutter cone assemblies may be satisfactorily used with the present invention including, but not limited to, cutter cone assemblies having milled teeth instead of inserts 104. Cuttings and other debris created by drill bit 20 may be carried from the bottom of borehole 24 to the well surface by drilling fluids exiting from nozzles 60. The debris carrying fluid generally flows radially outward from beneath drill bit 20 and then flows upward towards the well surface through annulus 26.

Drill bit 20 preferably comprises a one-piece or unitary bit body 40 with upper portion 42 having threaded connection or pin 44 adapted to secure drill bit 20 with the lower end of drill string 22. Three support arms 70 are preferably attached to and extend longitudinally from bit body 40 opposite from pin 44. Each support arm 70 preferably includes spindle 82 connected to and extending from inside surface 76 of the respective support arm 70. An important feature of the present invention includes the ability to remove one or more support arms 70 from bit body 40 and to rebuild drill bit 20 using the same bit body 40. Alternatively, support arms 70 and their associated cutter cone assemblies 100 may be removed from one bit body 40 and used to rebuild another drill bit 20.

Bit body 40 includes lower portion 46 having a generally convex exterior surface 48 formed thereon. The dimensions of convex surface 48 and the location of cutter cone assemblies 100 are selected to optimize fluid flow between lower portion 46 of bit body 40 and cutter cone assemblies 100. As will be explained later in more detail, the location of cutter cone assemblies 100 relative to lower portion 46 may be varied by adjusting the length of the associated support arm 70 and the spacing of each support arm 70 on the exterior of bit body 40.

As shown in FIGS. 2 and 3, bit body 40 includes middle portion 52 disposed between upper portion 42 and lower portion 46. Longitudinal axis or central axis 50 extends through bit body 40 and corresponds generally with the projected axis of rotation for drill bit 20. Middle portion 52 preferably has a generally cylindrical configuration with pockets 54 formed in the exterior thereof and spaced radially from each other. The number of pockets 54 is selected to correspond with the number of support arms 70 which will be attached thereto. The spacing between pockets 54 in the exterior of middle portion 52 is selected to correspond with the desired spacing between support arms 70 and their associated cutter cone assemblies 100. Any desired offset with respect to longitudinal axis 50 and the projected axis of rotation for drill bit 20 for cutter cone assemblies 100 may be provided by varying the position of the associated pocket 54. Various alternatives with respect to offsets will be discussed with respect to bit bodies 140 and 240 shown in FIGS. 5 and 6 respectively.

Each support arm 70 has a longitudinal axis 72 extending therethrough. Support arms 70 are preferably mounted in their respective pockets 54 with their respective longitudinal axis 72 aligned approximately parallel with each other and with longitudinal axis 50 of the associated bit body 40. For one application portions of each support arm 70 may be welded within its associated pocket 54 by a series of welds (not shown) formed between the perimeter of each pocket 54 and the adjacent portions of the associated support arm 70.

FIG. 3 is an exploded drawing which shows the relationship between a portion of bit body 40, one of the support arms 70 and its associated cutter cone assembly 100. Each cutter cone assembly 100 is preferably constructed and mounted on its associated spindle 82 in a substantially identical manner. Each support arm 70 is preferably constructed and mounted in its associated pocket 54 in substantially the same manner. Therefore, only one support arm 70 and cutter cone assembly 100 will be described in detail since the same description applies generally to the other two support arms 70 and their associated cutter cone assemblies 100.

Support arm 70 has a generally rectangular configuration with respect longitudinal axis 72. Support arm 70 has various configurations with respect to cross-sections taken normal to longitudinal axis 72. The configuration of support arm 70 may be varied in accordance with the teachings of the present invention depending upon the intended application for the associated drill bit 20. Support arm 70 preferably has a generally symmetrical configuration with respect to longitudinal axis 72 when viewed from either inside surface 76 or exterior surface 80. Support arm 70 and spindle 82 projecting therefrom also have a generally symmetrical configuration with respect to longitudinal axis 72 when viewed from the end of spindle 82 opposite from the associated support arm 70.

Support arm 70 includes top surface or upper end 74, inside surface 76, bottom edge 78 and exterior surface 80. Support arm 70 also includes sides 84 and 86 which preferably extend parallel with longitudinal axis 72. The dimensions of each support arm 70 are selected to be compatible with the associated pocket 54. As shown in FIGS. 2 and 3, a portion of each support arm 70, including upper end or top surface 74 and adjacent portions of inside surface 76 and sides 84 and 86 extending therefrom, is sized to fit within the associated pocket 54.

The portion of support arm 70 attached to the associated pocket 54 is defined in part by the width of support arm between sidewalls 84 and 86 and the thickness of support arm 70 between inside surface 76 and exterior surface 80. For one application at least one half of the thickness of this portion of support arm 70 is preferably disposed within and attached to the associated pocket 54.

As will be explained later in more detail with respect to FIGS. 7 and 8, inside surface 76 may be modified as desired to provide various features of the present invention. The configuration of inside surface 76 may vary substantially between top surface 74 and bottom edge 78. For the embodiment shown in FIGS. 2 and 8, inside surface 76 includes angled surfaces 144 and 146 which will be discussed later in more detail. Inside surface 76 and exterior surface 80 are contiguous at bottom edge 78 of the respective support arm 70. The portion of exterior surface 80 formed adjacent to bottom edge 78 is often referred to as shirttail surface 88.

Spindle 82 is preferably angled downwardly and inwardly with respect to both longitudinal axis 72 of support arm 70 and the projected axis of rotation of drill bit 20. This orientation of spindle 82 results in each cutter cone assembly 100 engaging the side and bottom of borehole 24 during drilling operations. For some applications, it may be preferable to position each support arm 70 and its associated spindle 82 with cutter cone assembly 100 having an offset from the projected axis of rotation of drill bit 20. The desired offset can be easily obtained by forming the associated pockets 54 in the exterior of bit body 40 with a corresponding offset from longitudinal axis 50 of bit body 40. The amount of offset may vary from zero to five or six degrees or zero inches to one half an inch in the direction of rotation of drill bit 20.

If desired, the lower portion of support arm 70 could be twisted with respect to longitudinal axis 72 to provide the desired offset. Also, spindle 82 could be twisted or angled with respect to longitudinal axis 72 to provide the desired offset. However, by varying the position of the associated pockets 54 to obtain any desired offset, it is possible to standardize support arms 70 and substantially reduce costs associated with manufacture and inventory of support arms 70 and their associated cutter cone assemblies 100.

As shown in FIGS. 1, 2, and 3, each cutter cone assembly 100 preferably includes base portion 108 with a conically shaped shell or tip 106 extending therefrom. For some applications, base portion 108 includes a frustoconically-shaped outer surface 110 which is preferably angled in a direction opposite from the angle of shell 106. Base 108 also includes backface 112 which may be disposed adjacent to portions of inside surface 76 of the associated support arm 70. An important feature of one embodiment of the invention includes the relationship between backface 112, the adjacent portions of inside surface 76 and shirttail 88 formed on exterior surface 80 of the associated support arm 70.

Base 108 preferably includes opening 120 with chamber 114 extending therefrom. Chamber 114 preferably extends through base 108 and into tip 106. The dimensions of opening 120 and chamber 114 are selected to allow mounting each cutter cone assembly 100 on its associated spindle 82. One or more bearing assemblies 122 are preferably mounted on spindle 82 and disposed between a bearing wall within chamber 114 and annular bearing surface 81 on spindle 82. A conventional ball retaining system 124 may be used to secure cutter cone assembly 100 to spindle 82.

Cutter cone assembly 100 may be manufactured of any hardenable steel or other high-strength engineering alloy which has adequate strength, toughness, and wear resistance to withstand the rigors of downhole drilling. Protection of bearing assembly 122 and any other bearings in chamber 114 which allow rotation of cutter cone assembly 100 can lengthen the useful service life of drill bit 20. Once drilling debris is allowed to infiltrate between the bearing surfaces of cutter cone assembly 100 and spindle 82, failure of drill bit 20 will follow shortly. The present invention provides for enhanced fluid flow around the exterior of drill bit 20 and the associated support arms 70 and cutter cone assemblies 100 to help keep debris from entering between the various bearing surfaces of each cutter cone assembly 100 and its associated spindle 82. Often an elastomeric seal such as seal 116 may be disposed within the gap between the bearing surfaces of cutter cone assembly 100 and the associated spindle 82. However, once seal 116 fails, drilling fluids and debris can quickly contaminate the bearing surfaces via the gap between cutter cone assembly 100 and its associated spindle 82.

For some applications, bit body 40 may be fabricated or machined from a generally cylindrical, solid piece of raw material or bar stock (not shown) having the desired metallurgical characteristics for the resulting drill bit 20. AISI 8620 alloy steel is an example of the type of material which may be used to form bit body 40.

Threaded connection 44 may be formed on upper portion 42 of bit body 40 using conventional threading techniques. One of the primary requirements in determining the outside diameter of middle portion 52 of bit body 40 is the amount of material thickness required to provide threaded connection 44. The following API table for roller bit connections shows various sizes of drill bits and the required pin size.

ROLLER BIT CONNECTIONS

| 1<br>Size of Bit, inches | 2<br>Size and Style of Rotary Pin Connection | 3<br>Bit Sub Bevel Dia. ±1/64 inches | 4<br>Bit Sub Bevel Dia. ±1/64 inches |
|---|---|---|---|
| 3 3/4 to 4 1/2, incl. | 2 3/8 REG | 3 3/64 | 3 5/64 |
| 4 5/8 to 5, incl. | 2 7/8 REG | 3 39/64 | 3 11/64 |
| 5 1/8 to 7 3/8, incl. | 3 1/2 REG | 4 7/64 | 4 9/64 |
| 7 1/2 to 9 3/8, incl. | 4 1/2 REG | 5 21/64 | 5 23/64 |
| 9 1/2 to 14 1/2, incl. | 6 5/8 REG | 7 23/64 | 7 25/64 |
| 14 5/8 to 18 1/2, incl. | 7 5/8 REG | 8 15/32 | 8 1/2 |
| 18 5/8 and larger | 8 5/8 REG | 9 35/64 | 9 37/64 |

The size of drill bit 20 is determined by the maximum outside diameter or gauge diameter associated with the three cutter cone assemblies 100. The position of each cutter cone assembly 100 relative to the projected axis of rotation of drill bit 20 is a function of the dimensions of pockets 54 and their associated support arms 70. Therefore, the same one-piece bit body 40 having threaded connection 44 appropriate for a $7\frac{1}{2}$ inch drill bit may also be used for a $9\frac{3}{8}$ inch drill bit or any drill bit size therebetween. It is important to note that as the drill bit size increases from $7\frac{1}{2}$ inches to $9\frac{3}{8}$ inches, the outside diameter of middle portion 52 of bit body 40 can remain essentially the same. Therefore, the flow area in annulus 26 between the exterior of bit body 40 and wall 28 of borehole 24 is substantially enhanced for a $9\frac{3}{8}$ inch drill bit as compared to a $7\frac{1}{2}$ inch drill bit.

As shown in FIG. 3, an enlarged cavity 56 may be formed within upper portion 42 of bit body 40. Opening 58 is provided in upper portion 42 for communicating fluids between drill string 22 and cavity 56. Cavity 56 preferably has a generally uniform inside diameter extending from opening 58 to a position intermediate middle portion 52 of bit body 40. For some applications, cavity 56 may be formed concentric with longitudinal axis 50 of bit body 40. One or more fluid passageways 62 may be formed in bit body 40 extending between cavity 56 and convex surface 48 on lower portion 46 of bit body 40. Nozzles or nozzle inserts 60 having one or more outlet orifices 59 may be disposed in each fluid passageway 62 to allow communicating fluids from cavity 56 through the respective fluid passageway 62 and the associated nozzle 60 to the exterior of bit body 40.

An important feature of the present invention includes the ability to vary the position of fluid passageways 62 and associated nozzles 60 within bit body 40 without affecting the location of pockets 54 and the associated support arms 70. For example, in FIG. 4, bit body 40 is shown with three pockets 54 and three fluid passageways 62 spaced radially with respect to each other around the perimeter of bit body 40. For the specific example shown in FIG. 4, fluid passageways 62 is spaced radially approximately one hundred twenty degrees (120°) from each other. In a similar manner, each support pocket 54 is spaced radially approximately one hundred twenty degrees (120°) from an adjacent pocket 54. An alternative embodiment of the present invention represented by bit body 40 shown in FIG. 5 includes fluid passageway 162 which extends substantially parallel to and concentric with longitudinal axis 50 of the associated bit body 140. One nozzle 60 may be disposed within fluid passageway 162 proximate the intersection of the associated convex surface 48 and longitudinal axis 50 of bit body 140.

Figure 4:
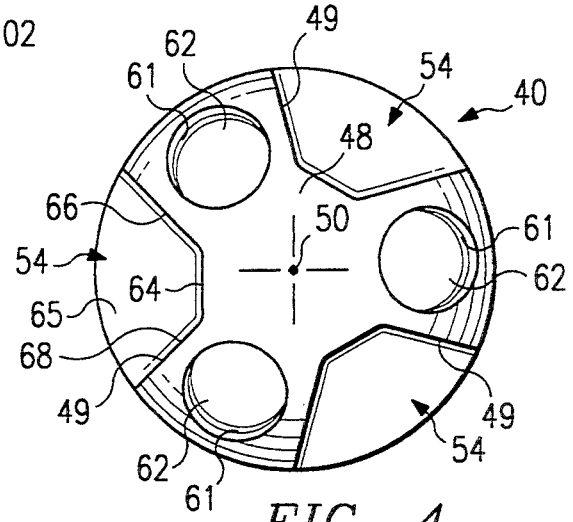
FIG. 4 is an end view of the bit body shown in FIG. 3.

As shown in FIGS. 2 and 4, each pocket 54 includes back wall 64 and a pair of side walls 66 and 68. The dimensions of back wall 64 and side walls 66 and 68 are selected to be compatible with the adjacent inside surface 76 and sides 84 and 86 of the associated support arm 70. The width ($W_p$) of each pocket is determined in part by the distance between the associated side walls 66 and 68. An important feature of the present invention includes limiting the combined width of support arms 70 to less than one-half the circumference of bit body 40. By limiting the width of support arms 70, sufficient void space 160 is provided between adjacent support arms 70 to allow for enhanced fluid flow between support arms 70 and convex surface 48 on lower portion 46 of bit body 40.

Another important feature of the present invention includes the ability to vary the length of support arm 70 to provide the desired fluid flow between the associated cutter cone assembly 100 mounted on each support arm 70 and the lower end convex surface 48 on lower portion 46 of bit body 40. For one application, the length of support arm 70 from top surface 74 to bottom edge 78 is preferably selected to be at least three times the width of support arm 70.

Figure 5:
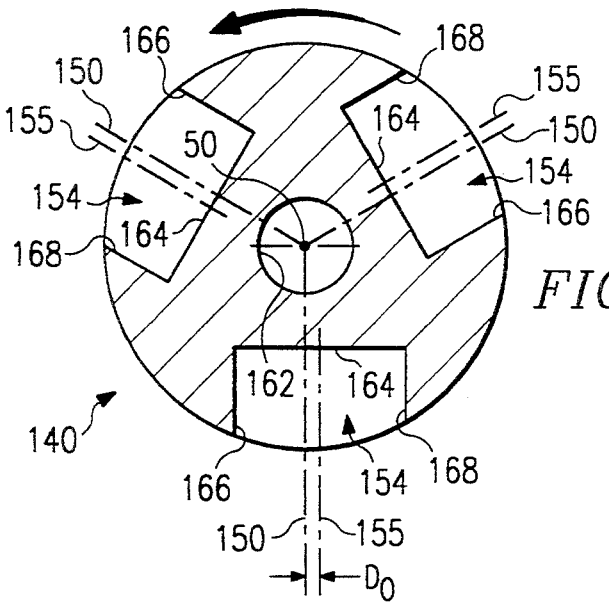
FIG. 5 is a schematic drawing in section showing an offset between the center line of pockets formed in a unitary bit body incorporating another embodiment of the present invention and the projected axis of rotation for an associated drill bit.

As previously noted, an alternative embodiment of the present invention is represented by bit body 140 shown in FIG. 5. Bit body 40 and bit body 140 have similar features except as noted below. Bit body 140 includes three pockets 154 having a generally square configuration as compared to pockets 54 of bit body 40. Inside surface 76 and sides 84 and 86 of support arm 70 may be modified as desired to conform with pockets 154. One of the benefits of the present invention includes the ability to vary the spacing of support arms 70 and their respective cutter cone assemblies 100 with respect to the projected axis of rotation of the associated drill bit 20 by varying the spacing of pockets 54 and/or 154 on the exterior of bit body 40 and 140 with respect to longitudinal axis 50.

In FIG. 5, radius lines 150 are shown extending radially from the center of bit body 140 which corresponds to longitudinal axis 50. Center line 155 of each pocket 154 is offset by distance ($D_0$) from the respective radius line 150. Typically, the amount of offset ($D_0$) is selected to correspond with the desired angular or radial spacing of zero to 5 or 6 degrees (0°–5° or 6°) relative to longitudinal axis 50 for the associated support arm 70 and cutter cone assembly 100. When center line 155 of each pocket 154 coincides with the respective radius line 150 there will be no offset between the associated cutter cone assemblies 100 and the projected axis of rotation for the drill bit 20. Depending upon the outside diameter of bit body 140, the amount of offset ($D_0$) may vary from zero to one-half an inch to provide the desired offset for the associated cutter cone assembly 100.

Figure 6:
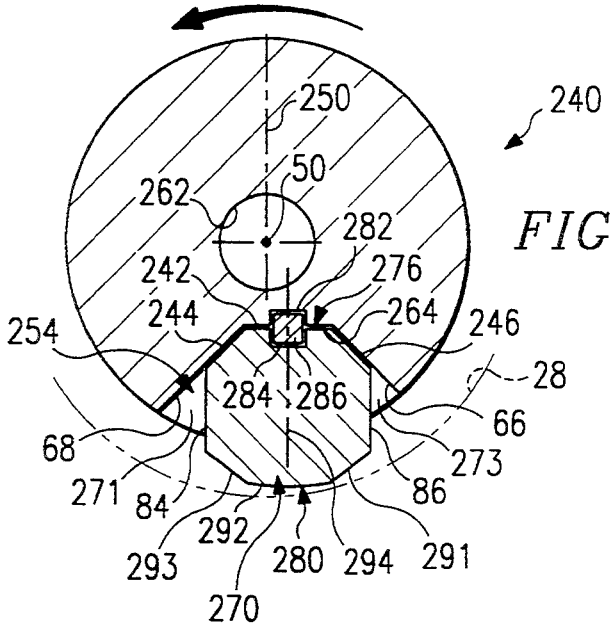
FIG. 6 is a drawing in section showing an alternative configuration of a pocket and support arm incorporating a further embodiment of the present invention.

Another alternative embodiment of the present invention is represented by bit body 240 and support arm 270 shown in FIG. 6. For purposes of illustration only one support arm 270 and its associated pocket 254 are shown in FIG. 6. Typically three support arms 270 and their associated cutter cone assemblies 100 will be mounted on bit body 240 in accordance with the present invention. Bit body 240 is shown with fluid passageway 262 extending substantially parallel with and concentric to longitudinal axis 250. Center line 294 of pocket 254 and the associated support arm 270 is shown offset from radius line 250 extending from longitudinal axis 50.

Pocket 254 includes back wall 264 with side walls 66 and 68 extending at an acute angle of approximately forty-five degrees (45°) relative to back wall 264. The portion of support arm 270 disposed in pocket 254 is shown with a generally octagon shaped cross-section defined in part by inside surface 276 having center portion 242 and angled surface 244 and 246 extending therefrom. The dimensions of inside surface 276 are selected to be compatible with the corresponding back wall 264 and side walls 66 and 68 of pocket 254. The generally octagon shaped cross-section of support arm 270 cooperates with the acutely angled side walls 66 and 68 of pocket 254 to provide void spaces 271 and 273 which may be used to assist in welding support arm 270 in its associated pocket 254. Also, the configuration of pocket 254 is compatible with increasing or decreasing the dimensions of the associated support arm 270 to manufacture drill bits having various gauge diameters from the same size bit body 240.

Exterior surface 280 of support arm 270 may include tapered surface 291 and 293 which extend longitudinally and generally parallel with each other on opposite sides of center line 294 of support arm 270. Center portion 292 of exterior surface 280 preferably extends longitudinally between tapered surfaces 291 and 293. For one application, center portion 292 has a radius of curvature approximately equal to one-half the radius of curvature of wall 28 for borehole 24.

For the embodiment of the invention shown in FIG. 6, keyway or key slot 282 is formed in back wall 264 and keyway or key slot 284 is formed on center portion 242 of inside surface 276. Key 286 is shown disposed in keyways 282 and 284 to assist with proper positioning and alignment of support arm 270 in its associated pocket 254 during assembly of the resulting drill bit. Various combinations of keys and keyways may be used for alignment and positioning of support arms 70 and 270 in pockets 54 and 254 respectively.

Figure 8:
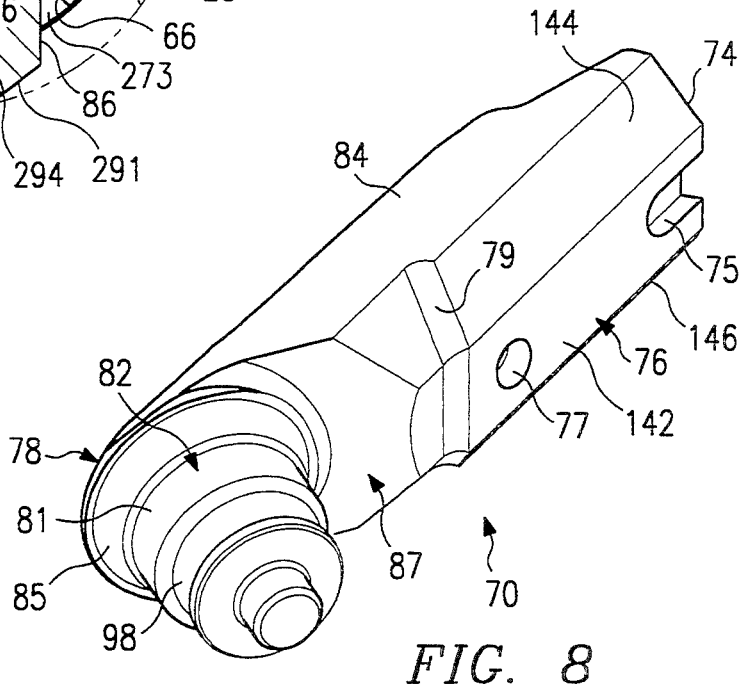
FIG. 8 is an isometric drawing of the support arm shown in FIG. 7.
Figure 7:
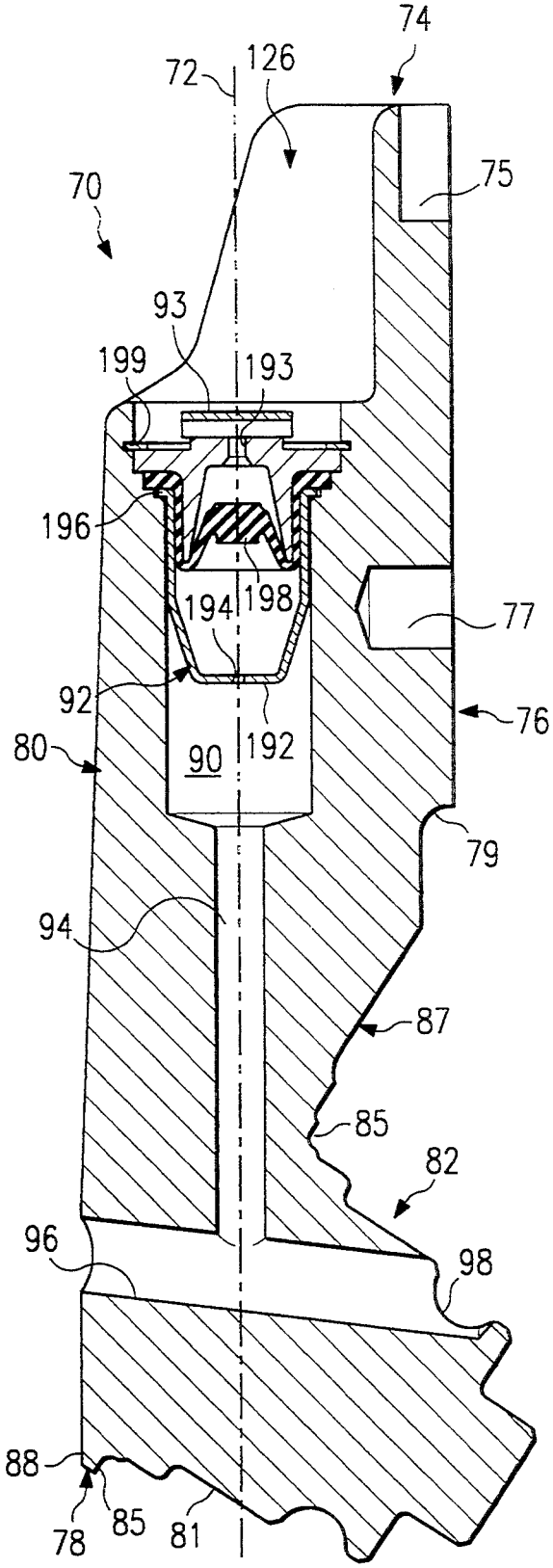
FIG. 7 is a drawing in section with portions broken away showing a support arm having a lubricant reservoir incorporating still another embodiment of the present invention.

Support arm 70 is shown in more detail in FIGS. 7 and 8. The portion of support arm 70 which is attached to pocket 54 has the same general exterior configuration as previously described with respect to support arm 270. One of the differences between support arm 270 and support arm 70 includes first opening 75 and second opening 77 which are formed on inside surface 76 of support arm 70. For one application, cavity 90 may be formed along longitudinal axis 72 of support arm 70 with opening 126 extending to the exterior of the associated rock bit 20. A portion of top surface 74, exterior surface 80 and adjacent sides 84 and 86 have been removed from the upper portion of support arm 70 to provide opening 126 and cavity 90 for installing lubricant reservoir 92 therein. The present invention allows forming both cavity 90 and passageway 94 during the same machining process. Lubricant container has a generally cylindrical configuration compatible with lubricant cavity 90. Lubricant container 92 includes closed end 192 having a lubricant opening extending therethrough. The opposite end of lubricant container 92 has a flanged shoulder 196 supporting a flexible, resilient diaphragm 198 which seals lubricant container 92 from the exterior of the associated drill bit. Cap 93 preferably covers diaphragm 198 and allows fluid pressure from the exterior of support arm 70 through opening 126 to act upon diaphragm 198. Snap ring 199 or another suitable mechanism may be used to install cap 93, diaphragm 198 and container 92 within cavity 90. Opening 193 in cap 93 allows communication of external fluid pressure with diaphragm 198. Lubricant container 92 and lubricant cavity 90 may be filled with a suitable lubricant through a filler port (not shown) in the side of support arm 70. Lubricant container 92 and lubricant passageway 94 cooperate to provide lubrication for bearing assemblies disposed between the exterior of spindle 82 and chamber 144 of the associated cutter cone assembly 100.

Lubricant passageway 94 is preferably formed in support arm 70 to allow communication of lubricant from cavity 90 to ball passageway 96 and ball bearings 124 disposed within ball race 98. Additional passageways (not shown) may be formed within spindle 82 to provide a lubricant flowpath to bearing assembly 122 disposed between cutter cone assembly 100 and spindle 82. By forming cavity 90 substantially parallel with longitudinal axis 72 of the associated support arm 70, lubricant reservoir 92 and the associated cap 93 are better protected during downhole drilling operations by increasing the distance between cap 93 and wall 28 of borehole 24. Top surface 74 and the portions of sides 84 and 86, which form opening 126, also cooperate with each other to protect cap 93 during drilling operations.

Cutter cone assembly 100 may be retained on its associated spindle 82 by inserting a plurality of ball bearings 124 through ball passageway 96 extending from exterior surface 80 of support arm 70 through spindle 82 and ball race 98 in spindle 82. A matching ball race will typically be provided on the interior of cutter cone assembly 100. Once inserted, ball bearings 124 in cooperation with the ball races will prevent disengagement of cutter cone assembly 100 from spindle 82. Ball passage 96 may be subsequently plugged by welding or other well known techniques. For some applications, a ball plug (not shown) may also be placed in passageway 96.

For one embodiment of the present invention, first opening 75 and second opening 77 are formed in inside surface 76 of each support arm 70. First post or dowel 53 and second post or dowel 55 are preferably disposed in back wall 64 of each pocket 54. Posts 53 and 54 extend radially from each back wall 64 to cooperate respectively with first opening 75 and second opening 77 to position each support arm 70 within its associated pocket 54 during assembly of drill bit 20. For one embodiment of the present invention, first opening 75 preferably comprises a longitudinal slot extending from top surface 74 and sized to receive first post 53 therein. Second opening 77 preferably has a generally circular configuration sized to receive second post 55 therein. First opening 75 is preferably formed as a longitudinal slot to compensate for any variation between the dimensions of support arm 70 and its associated pocket 54 including the relative position of first opening 75, second opening 77 and the respective first post 53 and second post 55.

This configuration of first opening 75 and second opening 77 is particularly beneficial during the manufacture and/or rebuilding of the associated drill bit. For example, one of the support arms 70 may be removed from its associated pocket 54 and a new support arm 70 installed therein, even though the new support arm 70 may be manufactured with some variation from the dimensions of the original support arm 70. Also, posts or dowels 53 and 54 could be initially disposed extending from inside surface 76 of support arm 70 with appropriate openings provided in back wall 64 of the associated pocket 54.

Although the present invention and its advantages have been described in detail, it should be understood that various changes, substitutions and alterations can be made therein without departing from the spirit and scope of the invention as defined by the appended claims.

What is claimed is:

1. A rotary cone drill bit for forming a borehole, comprising:

a one-piece bit body having an upper portion adapted for connection to a drill string for rotation of said drill bit;

said bit body having a longitudinal axis corresponding approximately with the projected axis of rotation of said drill bit;

a number of support arms attached to said bit body and extending opposite from said upper portion each of said support arms having an inside surface with a spindle connected thereto, each spindle projecting generally downwardly and inwardly with respect to its associated support arm;

each of said support arms having a longitudinal axis extending substantially parallel with the longitudinal axis of said bit body;

a number of cutter cone assemblies equal to said number of support arms with each cutter cone assembly mounted respectively on one of said spindles;

said bit body having a lower portion with a generally convex exterior surface formed thereon to provide enhanced fluid flow between said cutter cone assemblies and said lower portion of said bit body; and said bit body having a middle portion disposed between said upper portion and said lower portion of said bit body with a number of pockets formed in the exterior of said middle portion for attaching said support arms to said bit body with said number of pockets equal to said number of support arms.

2. The drill bit as defined by claim 1 wherein each of said pockets further comprises:

a center line extending through said pocket and said support arm attached to said pocket; and a radius line extending from said longitudinal axis of said bit body substantially parallel with said center line and center arm offset a distance from said radius line.

3. The drill bit as defined by claim 1 wherein each of said pockets further comprises:

a back wall extending substantially parallel with said longitudinal axis of said bit body;

a pair of side walls extending substantially normal to said back wall; and the dimensions of said back wall and said side walls selected to allow inserting a portion of one of said support arms partially therein.

4. The drill bit as defined by claim 1 wherein each of said pockets comprises:

a back wall extending substantially parallel with said longitudinal axis of said bit body;

a pair of side walls extending at an acute angle relative to said back wall; and the dimensions of said back wall and said side walls selected to allow inserting a portion of one of said support arms partially therein.

5. The drill bit as defined in claim 1 further comprising:

at least one bearing assembly disposed between each spindle and its associated cutter cone assembly;

a reservoir containing lubricant disposed within each support arm;

a fluid passageway extending through each support arm from its respective reservoir to said bearing assembly for communicating lubricant between said respective reservoir and said bearing assembly; and said fluid passageway having an inside diameter and said lubricant reservoir having a generally cylindrical configuration with an outside diameter larger than said inside diameter of said fluid passageway with said lubricant reservoir aligned concentric with a portion of said fluid passageway.

6. The drill bit as defined by claim 1 further comprising:

each pocket having a back wall with a first post and a second post extending radially from said back wall;

a first opening and a second opening formed in said inside surface of each support arm; and said first opening and said second opening cooperating respectively with said first post and said second post for positioning each support arm within its associated pocket.

7. The drill bit as defined by claim 6 further comprising:

said first opening in said inside surface of each support arm defined in part by a longitudinal slot extending partially therethrough and sized to receive said first post therein; and said second opening in said inside surface of each support arm defined in part by a circular hole sized to receive said second post therein.

8. The drill bit as defined by claim 1 further comprising:

each pocket having a back wall with a keyway formed therein;

a matching key extending radially from said inside surface of each support arm and projecting therefrom; and said key and said keyway cooperating with each other for alignment and positioning of each support arm within its associated pocket during fabrication of the drill bit.

9. The drill bit as defined by claim 1 further comprising:

each pocket having a key extending radially therefrom;

a matching keyway formed in said inside surface of each support arm and sized to receive said key of said associated pocket therein; and said key and said keyway cooperating with each other for alignment and positioning of each support arm within its associated pocket during fabrication of said drill bit.

10. The drill bit as defined by claim 1 further comprising:

each support arm having an upper end disposed within its associated pocket and a bottom edge adjacent to said spindle; and the length of each support arm from said upper end to said bottom edge selected to be at least three times the width of said support arm.

11. The drill bit as defined by claim 1 further comprising:

a portion of each support arm attached with one of said pockets;

said portion of each support arm having a width and a thickness with respect to said longitudinal axis; and at least one half of said thickness of said portion of each support arm disposed within and attached to one of said pockets.

12. A support arm and cutter cone assembly for a rotary cone drill bit having a bit body comprising:

said support arm having a longitudinal axis extending therethrough and an upper end, an inside surface, an exterior surface with a shirttail surface formed as a part thereof and a bottom edge with said inside surface and said shirttail surface contiguous at said bottom edge;

said support arm having a first side and a second side extending from said inside surface;

the dimensions of said upper end and the adjacent portions of said inside surface and said first side and said second side selected to allow securing a portion of said support arm within a pocket formed in said bit body;

a spindle attached to said inside surface near said bottom edge and angled downwardly and inwardly with respect to said support arm;

said cutter cone assembly having an opening and a chamber extending therefrom for mounting said cutter cone assembly on said spindle; and means provided on said inside surface of said support arm for alignment and positioning of said support arm within said pocket during fabrication of said drill bit.

13. The support arm of claim 12 wherein the length of said support arm from its upper end to its bottom edge is selected to be at least three times the width of said support arm.

14. The support arm of claim 12 further comprising:

a first opening and a second opening formed on said inside surface of said support arm; and said first opening and said second opening cooperating respectively with a first post and a second post provided by an associated pocket of said bit body for positioning said support arm within said associated pocket.

15. The support arm of claim 14 further comprising:

said first opening in said inside surface of said support arm defined in part by a longitudinal slot extending partially there through and sized to receive said first post therein; and said second opening in said inside surface of said support arm defined in part by a circular hole sized to receive said second post therein.

16. The support arm of claim 12 further comprising:

a keyway formed in said inside surface of said support arm and sized to receive a key disposed in an associated pocket of said bit body; and said key and said keyway cooperating with each other for alignment and positioning of said support arm within said associated pocket.

17. The support arm as defined by claim 12 further comprising:

a key projecting from said inside surface of said support arm for insertion into a matching keyway formed in an associated pocket of said bit body; and said key and said keyway cooperating with each other or alignment and positioning of said support arm within said associated pocket.

18. The support arm and cutter cone assembly of claim 12 wherein said cutter cone assembly further comprises a generally conical cutter body having a base with an opening formed therein and a tip pointed away from said opening, an outer portion of said base having a generally frustoconically-shape directed away from said base and surrounding said opening.

19. The support arm and cutter cone assembly of claim 12 further comprising:

a bearing assembly disposed between said spindle and said cutter cone assembly;

a reservoir containing lubricant disposed within said support arm;

said reservoir having a longitudinal axis extending substantially parallel with said longitudinal axis of said support arm; and a fluid passageway extending from said reservoir to said bearing assembly for communicating lubricant between said reservoir and said bearing assembly.

20. The support arm and cutter cone assembly of claim 19 further comprising:

said reservoir disposed in an upper portion of said support arm through an opening in said exterior surface of said support arm; and a portion of said fluid passageway extending from said reservoir to said bearing assembly disposed substantially parallel with said longitudinal axis of said support arm.

21. The support arm and cutter cone assembly of claim 12 further comprising:

said first side and said second side formed substantially parallel with each other and said longitudinal axis; and said first side and said second side extending between said inside surface and said exterior surface.

22. The support arm and cutter cone assembly of claim 12 wherein a portion of said support arm further comprises a generally octagon shaped cross section normal to said longitudinal axis.

23. The support arm and cutter cone assembly of claim 12 further comprising said support arm having a generally symmetrical configuration with respect to said longitudinal axis of said support arm and said spindle.

* * * * *

UNITED STATES PATENT AND TRADEMARK OFFICE

CERTIFICATE OF CORRECTION

PATENT NO. : 5,439,068

DATED : August 8, 1995

INVENTOR(S) : Huffstutler, et al.

It is certified that error appears in the above-identified patent and that said Letters Patent is hereby corrected as shown below:

Column 9, line 11, after "body" delete "40" and isnert -- 140 --.

Column 13, line 13, after "other" delete "or" and insert -- for --.

Signed and Sealed this

Nineteenth Day of March, 1996

Bruce Lehman

*Attest:*

BRUCE LEHMAN

*Attesting Officer*

*Commissioner of Patents and Trademarks*

US005439068B1

REEXAMINATION CERTIFICATE (3108th)

United States Patent [19] [11] B1 5,439,068

Huffstutler et al. [45] Certificate Issued Jan. 14, 1997

[54] MODULAR ROTARY DRILL BIT

[75] Inventors: Alan D. Huffstutler, Grand Prairie; Wesley P. Dietz, DeSoto, both of Tex.

[73] Assignee: Dresser Industries, Inc., Dallas, Tex.

Reexamination Request:
No. 90/004,218, Apr. 8, 1996

Reexamination Certificate for:

| | |
|---|---|
| Patent No.: | **5,439,068** |
| Issued: | **Aug. 8, 1995** |
| Appl. No.: | **287,446** |
| Filed: | **Aug. 8, 1994** |

Certificate of Correction issued Mar. 19, 1996.

[51] Int. Cl.[6] ..... E21B 10/08; E21B 10/24
[52] U.S. Cl. ..... 175/356; 175/227; 76/108.4
[58] Field of Search ..... 175/369, 356, 175/357, 366, 367, 331, 374, 227; 76/108.2, 108.4

[56] References Cited

U.S. PATENT DOCUMENTS

| | | | |
|---|---|---|---|
| Re. 32,495 | 9/1987 | Coates | 175/339 |
| D. 265,205 | 6/1980 | Munson | D15/139 |
| 1,908,049 | 5/1933 | Reed | 175/367 |
| 2,030,723 | 2/1936 | Scott et al. | 175/362 |
| 2,065,743 | 12/1936 | Reed | 175/366 |
| 2,124,521 | 7/1938 | Williams | 175/366 |
| 2,151,347 | 3/1939 | Fisher | 175/366 |
| 2,176,358 | 10/1939 | Pearce | 175/354 |
| 2,260,487 | 10/1941 | Scott | 175/340 |
| 2,318,370 | 5/1943 | Burch | 175/366 |
| 2,634,105 | 4/1953 | Gruner | 175/341 |
| 2,648,526 | 8/1953 | Lanchester | 175/366 |
| 2,782,005 | 2/1957 | Appleton | 175/366 |
| 2,807,444 | 9/1957 | Reifschneider | 175/339 |
| 2,950,090 | 8/1960 | Swart | 175/340 |
| 3,130,801 | 4/1964 | Schumacher, Jr. | 175/374 |
| 3,442,342 | 5/1969 | McElya et al. | 175/374 |
| 3,800,891 | 4/1974 | White et al. | 175/374 |

(List continued on next page.)

FOREIGN PATENT DOCUMENTS

| | | |
|---|---|---|
| 936382 | 12/1955 | Germany . |
| 533719 | 10/1976 | U.S.S.R. . |
| 732483 | 8/1980 | U.S.S.R. . |
| 1305295 | 4/1987 | U.S.S.R. . |
| 1467157 | 3/1989 | U.S.S.R. . |

OTHER PUBLICATIONS

International Search Report dated Sep. 5, 1996 for pending International Application No. PCT/US96/08522.

International Application No. PCT/US95/10015 Search Report dated Jan. 4, 1996.

Security Oilfield Catalog, Rock Bits Diamond Products Drilling Tool, 2 pages, undated.

(List continued on next page.)

*Primary Examiner*—Frank S. Tsay

[57] ABSTRACT

A rotary cone drill bit for forming a borehole having a one-piece bit body with a lower portion having a convex exterior surface and an upper portion adapted for connection to a drill string. The drill bit will generally rotate around a central axis of the bit body. A number of support arms are preferably attached to pockets formed in the bit body and depend therefrom. Each support arm has an inside surface with a spindle connected thereto and an outer surface. Each spindle projects generally downwardly and inwardly with respect to the longitudinal axis of the associated support arm and the central axis of the bit body. A number of cone cutter assemblies equal to the number of support arms are mounted respectively on each of the spindles. The spacing between each of the support arms along with their respective length and width dimensions are selected to enhance fluid flow between the cutter cone assemblies mounted on the respective support arms and the lower portion of the bit body. A lubricant reservoir is preferably provided in each support arm to supply lubricant to one or more bearing assemblies disposed between each cutter cone assembly and its associated spindle. Either matching openings and posts or matching keyways and keys may be used to position and align a portion of each support arm within its associated pocket during fabrication of the resulting drill bit.

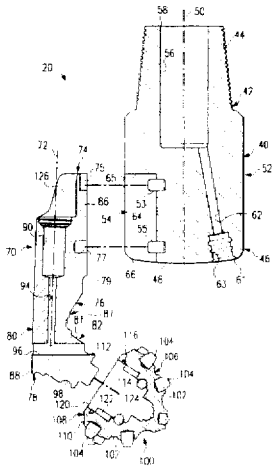

U.S. PATENT DOCUMENTS

| | | | |
|---|---|---|---|
| 3,850,256 | 11/1974 | McQueen | 175/228 |
| 4,054,772 | 10/1977 | Lichte | 219/121 EM |
| 4,056,153 | 11/1977 | Miglierini | 175/376 |
| 4,067,406 | 1/1978 | Garner et al. | 175/341 |
| 4,098,448 | 7/1978 | Sciaky et al. | 228/102 |
| 4,145,094 | 3/1979 | Vezirian | 308/8.2 |
| 4,187,743 | 2/1980 | Thomas | 76/108 A |
| 4,209,124 | 6/1980 | Baur et al. | 228/182 |
| 4,256,194 | 3/1981 | Varel | 175/375 |
| 4,258,807 | 3/1981 | Fischer et al. | 175/375 |
| 4,280,571 | 7/1981 | Fuller | 175/337 |
| 4,333,364 | 6/1982 | Varel | 76/108 A |
| 4,350,060 | 9/1982 | Vezirian | 76/108 A |
| 4,369,849 | 1/1983 | Parrish | 175/340 |
| 4,624,329 | 11/1986 | Evans et al. | 175/374 |
| 4,630,693 | 12/1986 | Goodfellow | 175/366 |
| 4,635,728 | 1/1987 | Harrington | 166/341 |
| 4,657,091 | 4/1987 | Higdon | 175/229 |
| 4,711,143 | 12/1987 | Loukanis et al. | 76/108 A |
| 4,765,205 | 8/1988 | Higdon | 76/108 |
| 4,813,502 | 3/1989 | Dysart | 175/337 |
| 4,817,852 | 4/1989 | Hill | 228/114 |
| 5,040,623 | 8/1991 | Vezirian | 175/354 |
| 5,158,148 | 10/1992 | Keshavan | 175/426 |
| 5,189,932 | 3/1993 | Palmo et al. | 76/108.2 |
| 5,199,516 | 4/1993 | Fernandez | 175/366 |
| 5,224,560 | 7/1993 | Fernandez | 175/374 |
| 5,281,260 | 1/1994 | Kumar et al. | 75/240 |
| 5,351,768 | 10/1994 | Scott et al. | 175/374 |
| 5,439,067 | 8/1995 | Huffstutler | 175/339 |

OTHER PUBLICATIONS

Carlos Fernandez, *SpaceBit, State of the Science in Rock Bit Tech.* (Date appearing on illustration Aug. 8, 1991).

Brochure, Security DBS, *New ERA™Series,* 1995, 1 page.

Brochure, Security DBS, *The New ERA in Drill Bit Performance Has Arrived,* (undated), 2 pages.

U.S. Patent Application Ser. No. 08/478,455 filed Jun. 9, 1995 entitled *Rotary Cone Drill Bit Modular Arm,* pending.

U.S. Patent Application Ser. No. 08/422,140 filed Apr. 13, 1995 entitled *Rotary Drill Bit and Method for Manufacture and Rebuild,* pending.

U.S. Design Patent Application Ser. No. 29/043,782 filed Sep. 12, 1995 entitled *Rotary Cone Drill Bit,* pending.

REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

The patentability of claims 2, 4–9 and 12–23 is confirmed.

Claims 1, 3, 10 and 11 are cancelled.

* * * * *

US005439068B1

REEXAMINATION CERTIFICATE (3108th)

United States Patent [19] [11] B1 5,439,068

Huffstutler et al. [45] Certificate Issued Jan. 14, 1997

[54] MODULAR ROTARY DRILL BIT

[75] Inventors: Alan D. Huffstutler, Grand Prairie; Wesley P. Dietz, DeSoto, both of Tex.

[73] Assignee: Dresser Industries, Inc., Dallas, Tex.

Reexamination Request:
No. 90/004,218, Apr. 8, 1996

Reexamination Certificate for:

| | |
|---|---|
| Patent No.: | **5,439,068** |
| Issued: | **Aug. 8, 1995** |
| Appl. No.: | **287,446** |
| Filed: | **Aug. 8, 1994** |

Certificate of Correction issued Mar. 19, 1996.

[51] Int. Cl.[6] ..... E21B 10/08; E21B 10/24
[52] U.S. Cl. ..... 175/356; 175/227; 76/108.4
[58] Field of Search ..... 175/369, 356, 175/357, 366, 367, 331, 374, 227; 76/108.2, 108.4

[56] References Cited

U.S. PATENT DOCUMENTS

| | | | |
|---|---|---|---|
| Re. 32,495 | 9/1987 | Coates | 175/339 |
| D. 265,205 | 6/1980 | Munson | D15/139 |
| 1,908,049 | 5/1933 | Reed | 175/367 |
| 2,030,723 | 2/1936 | Scott et al. | 175/362 |
| 2,065,743 | 12/1936 | Reed | 175/366 |
| 2,124,521 | 7/1938 | Williams | 175/366 |
| 2,151,347 | 3/1939 | Fisher | 175/366 |
| 2,176,358 | 10/1939 | Pearce | 175/354 |
| 2,260,487 | 10/1941 | Scott | 175/340 |
| 2,318,370 | 5/1943 | Burch | 175/366 |
| 2,634,105 | 4/1953 | Gruner | 175/341 |
| 2,648,526 | 8/1953 | Lanchester | 175/366 |
| 2,782,005 | 2/1957 | Appleton | 175/366 |
| 2,807,444 | 9/1957 | Reifschneider | 175/339 |
| 2,950,090 | 8/1960 | Swart | 175/340 |
| 3,130,801 | 4/1964 | Schumacher, Jr. | 175/374 |
| 3,442,342 | 5/1969 | McElya et al. | 175/374 |
| 3,800,891 | 4/1974 | White et al. | 175/374 |

(List continued on next page.)

FOREIGN PATENT DOCUMENTS

| | | |
|---|---|---|
| 936382 | 12/1955 | Germany . |
| 533719 | 10/1976 | U.S.S.R. . |
| 732483 | 8/1980 | U.S.S.R. . |
| 1305295 | 4/1987 | U.S.S.R. . |
| 1467157 | 3/1989 | U.S.S.R. . |

OTHER PUBLICATIONS

International Search Report dated Sep. 5, 1996 for pending International Application No. PCT/US96/08522.

International Application No. PCT/US95/10015 Search Report dated Jan. 4, 1996.

Security Oilfield Catalog, Rock Bits Diamond Products Drilling Tool, 2 pages, undated.

(List continued on next page.)

*Primary Examiner*—Frank S. Tsay

[57] ABSTRACT

A rotary cone drill bit for forming a borehole having a one-piece bit body with a lower portion having a convex exterior surface and an upper portion adapted for connection to a drill string. The drill bit will generally rotate around a central axis of the bit body. A number of support arms are preferably attached to pockets formed in the bit body and depend therefrom. Each support arm has an inside surface with a spindle connected thereto and an outer surface. Each spindle projects generally downwardly and inwardly with respect to the longitudinal axis of the associated support arm and the central axis of the bit body. A number of cone cutter assemblies equal to the number of support arms are mounted respectively on each of the spindles. The spacing between each of the support arms along with their respective length and width dimensions are selected to enhance fluid flow between the cutter cone assemblies mounted on the respective support arms and the lower portion of the bit body. A lubricant reservoir is preferably provided in each support arm to supply lubricant to one or more bearing assemblies disposed between each cutter cone assembly and its associated spindle. Either matching openings and posts or matching keyways and keys may be used to position and align a portion of each support arm within its associated pocket during fabrication of the resulting drill bit.

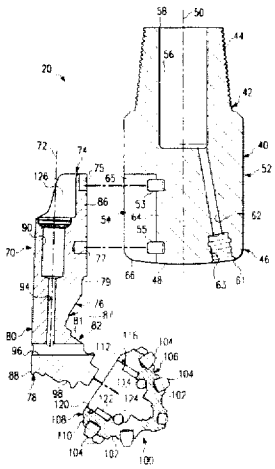

U.S. PATENT DOCUMENTS

| | | | |
|---|---|---|---|
| 3,850,256 | 11/1974 | McQueen | 175/228 |
| 4,054,772 | 10/1977 | Lichte | 219/121 EM |
| 4,056,153 | 11/1977 | Miglierini | 175/376 |
| 4,067,406 | 1/1978 | Garner et al. | 175/341 |
| 4,098,448 | 7/1978 | Sciaky et al. | 228/102 |
| 4,145,094 | 3/1979 | Vezirian | 308/8.2 |
| 4,187,743 | 2/1980 | Thomas | 76/108 A |
| 4,209,124 | 6/1980 | Baur et al. | 228/182 |
| 4,256,194 | 3/1981 | Varel | 175/375 |
| 4,258,807 | 3/1981 | Fischer et al. | 175/375 |
| 4,280,571 | 7/1981 | Fuller | 175/337 |
| 4,333,364 | 6/1982 | Varel | 76/108 A |
| 4,350,060 | 9/1982 | Vezirian | 76/108 A |
| 4,369,849 | 1/1983 | Parrish | 175/340 |
| 4,624,329 | 11/1986 | Evans et al. | 175/374 |
| 4,630,693 | 12/1986 | Goodfellow | 175/366 |
| 4,635,728 | 1/1987 | Harrington | 166/341 |
| 4,657,091 | 4/1987 | Higdon | 175/229 |
| 4,711,143 | 12/1987 | Loukanis et al. | 76/108 A |
| 4,765,205 | 8/1988 | Higdon | 76/108 |
| 4,813,502 | 3/1989 | Dysart | 175/337 |
| 4,817,852 | 4/1989 | Hill | 228/114 |
| 5,040,623 | 8/1991 | Vezirian | 175/354 |
| 5,158,148 | 10/1992 | Keshavan | 175/426 |
| 5,189,932 | 3/1993 | Palmo et al. | 76/108.2 |
| 5,199,516 | 4/1993 | Fernandez | 175/366 |
| 5,224,560 | 7/1993 | Fernandez | 175/374 |
| 5,281,260 | 1/1994 | Kumar et al. | 75/240 |
| 5,351,768 | 10/1994 | Scott et al. | 175/374 |
| 5,439,067 | 8/1995 | Huffstutler | 175/339 |

OTHER PUBLICATIONS

Carlos Fernandez, *SpaceBit, State of the Science in Rock Bit Tech.* (Date appearing on illustration Aug. 8, 1991).

Brochure, Security DBS, *New ERA™Series,* 1995, 1 page.

Brochure, Security DBS, *The New ERA in Drill Bit Performance Has Arrived,* (undated), 2 pages.

U.S. Patent Application Ser. No. 08/478,455 filed Jun. 9, 1995 entitled *Rotary Cone Drill Bit Modular Arm,* pending.

U.S. Patent Application Ser. No. 08/422,140 filed Apr. 13, 1995 entitled *Rotary Drill Bit and Method for Manufacture and Rebuild,* pending.

U.S. Design Patent Application Ser. No. 29/043,782 filed Sep. 12, 1995 entitled *Rotary Cone Drill Bit,* pending.

REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

The patentability of claims 2, 4–9 and 12–23 is confirmed.

Claims 1, 3, 10 and 11 are cancelled.

* * * * *